US006574901B1

(12) United States Patent
Solinsky et al.

(10) Patent No.: US 6,574,901 B1
(45) Date of Patent: Jun. 10, 2003

(54) AUXILIARY DEVICE FOR A WEAPON AND ATTACHMENT THEREOF

(75) Inventors: Kenneth S. Solinsky, Bedford, NH (US); Albert Lapage, Weare, NH (US); Wallace Woodman, Merrimack, NH (US)

(73) Assignee: Insight Technology Incorporated, Londonderry, NH (US)

( * ) Notice: Subject to any disclaimer, the term of this patent is extended or adjusted under 35 U.S.C. 154(b) by 0 days.

(21) Appl. No.: 09/706,085

(22) Filed: Nov. 3, 2000

Related U.S. Application Data

(63) Continuation of application No. 09/109,048, filed on Jul. 2, 1998, now Pat. No. 6,185,854.

(51) Int. Cl.[7] ..... F41G 1/35
(52) U.S. Cl. ..... 42/146; 42/114; 362/110
(58) Field of Search ..... 42/103, 114, 117, 42/146; 362/110, 113, 114

(56) References Cited

U.S. PATENT DOCUMENTS

| | | | |
|---|---|---|---|
| 689,547 | A | 12/1901 | James |
| 894,306 | A | 7/1908 | Wright |
| 933,095 | A | 9/1909 | Mosteller |
| 957,299 | A | 5/1910 | Barnes |
| 958,332 | A | 5/1910 | Snyder |
| 982,280 | A | 1/1911 | Lewis |
| 1,120,769 | A | 12/1914 | Villarejo |
| 1,149,705 | A | 8/1915 | Ward |
| 1,215,171 | A | 2/1917 | Lewis |
| 1,222,778 | A | 4/1917 | McCleary |
| 1,262,270 | A | 4/1918 | Schmidt et al. |
| 1,263,667 | A | 4/1918 | Henderson et al. |
| 1,338,239 | A | 4/1920 | Matys |
| 1,427,042 | A | 8/1922 | Wetmore |
| 1,452,651 | A | 4/1923 | Norrlin |
| 1,826,004 | A | 10/1931 | Key |
| 1,865,127 | A | 6/1932 | McKeen |
| 1,877,016 | A | 9/1932 | Munson |
| 1,993,979 | A | 3/1935 | Reed |
| 2,017,585 | A | 10/1935 | Casey |

(List continued on next page.)

FOREIGN PATENT DOCUMENTS

| | | | |
|---|---|---|---|
| AT | 274620 | 12/1968 | ..... 33/250 |
| CH | 217521 | 2/1942 | |
| DE | 1101223 | 3/1961 | ..... 33/252 |
| EP | 0 335 281 A2 | 10/1989 | |
| FR | 2 592 149 A1 | 6/1987 | |
| GB | 13444 | 11/1885 | ..... 33/248 |
| GB | 818524 | 8/1959 | |
| GB | 2 052 025 A | 1/1981 | |

OTHER PUBLICATIONS

Heckler & Koch, Inc.; Sentinal (Product Catalog) 1993 Edition; 24 pages total.

Commercial Laser Safety Standards; 1 page from www.n-swc.navy.mil website no date.

Laser Safety Manual, University of Waterloo Safety Office; Oct. 24, 1996; 4 pages from www.adm.uwaterloo.ca website.

(List continued on next page.)

*Primary Examiner*—Stephen M. Johnson
(74) *Attorney, Agent, or Firm*—Fish & Richardson P.C.

(57) ABSTRACT

An attachment system is provided for attaching an auxiliary apparatus to a weapon having a frame, and in particular to a weapon frame in the area forward of the trigger guard. An attachment mechanism on the auxiliary apparatus is adapted to be engageable with a rail on the weapon to selectively attach the auxiliary apparatus. The weapon may include a transverse slot which can be engaged by a portion of the auxiliary apparatus to prevent the auxiliary apparatus from sliding relative to the weapon due to recoil forces associated with firing the weapon.

35 Claims, 8 Drawing Sheets

U.S. PATENT DOCUMENTS 2,085,732 A 7/1937 Baxter et al.
2,108,475 A 2/1938 Cooper
2,158,915 A 5/1939 Searcy
2,209,524 A 7/1940 Key
2,236,736 A 4/1941 Scott
2,314,061 A 3/1943 Whaley
2,336,718 A 12/1943 Davis
2,385,649 A 9/1945 Prideaux
2,450,584 A 10/1948 Dodge
2,529,057 A 11/1950 Teffault
2,546,242 A 3/1951 Stinson
2,597,565 A 5/1952 Chandler et al.
2,645,017 A 7/1953 Haase ..... 42/100
2,657,303 A 10/1953 Dickens
2,844,710 A 7/1958 Zinsser
2,912,566 A 11/1959 Cornett
3,010,019 A 11/1961 Sohst
3,019,542 A 2/1962 Manthos
3,153,856 A 10/1964 Felix ..... 33/247
3,222,022 A 12/1965 Akin, Jr.
3,222,511 A 12/1965 Breeding
3,243,896 A 4/1966 Immarco et al.
3,417,237 A 12/1968 Fenton
3,447,033 A 5/1969 Redmond et al.
3,454,898 A 7/1969 Comstock
3,509,344 A 4/1970 Bouwers
3,513,581 A 5/1970 Slater
3,562,944 A 2/1971 Wagner et al.
3,633,285 A 1/1972 Sensney
3,656,845 A 4/1972 Koch-Bossard et al.
3,739,167 A 6/1973 Avery
3,742,636 A 7/1973 Dealy et al.
3,782,832 A 1/1974 Hacskaylo
3,787,693 A 1/1974 Stone
3,834,052 A 9/1974 Steck, III
3,867,764 A 2/1975 Dunmire et al.
3,877,166 A 4/1975 Wavd ..... 42/101
3,898,747 A 8/1975 Marshall
3,938,262 A 2/1976 Dye et al.
3,974,585 A 8/1976 Dunham
3,995,376 A 12/1976 Kimble et al.
4,000,403 A 12/1976 Rice
4,026,054 A 5/1977 Snyder
4,027,159 A 5/1977 Bishop
4,044,486 A 8/1977 Van Holten
4,069,414 A 1/1978 Bell
4,079,534 A 3/1978 Snyder
4,112,300 A 9/1978 Hall, Jr. et al.
4,152,754 A 5/1979 deFilippis et al.
4,161,076 A 7/1979 Snyder
4,168,588 A 9/1979 Snyder
4,212,109 A 7/1980 Snyder
4,266,873 A 5/1981 Hacskaylo
4,281,993 A 8/1981 Shaw
4,291,479 A 9/1981 Lough
4,295,289 A 10/1981 Snyder
4,310,980 A 1/1982 Pilkington
4,313,272 A 2/1982 Matthews
4,313,273 A 2/1982 Matthews et al.
4,315,150 A 2/1982 Darringer et al.
4,383,371 A 5/1983 Coffey ..... 33/247
4,417,814 A 11/1983 Doliber
4,418,487 A 12/1983 Strahan
4,446,644 A 5/1984 Jimenez et al.
4,542,447 A 9/1985 Quakenbush
4,554,744 A 11/1985 Huckenbeck
4,561,775 A 12/1985 Patrick et al.
4,571,870 A 2/1986 Heideman et al.
4,627,183 A 12/1986 Stuckman
4,658,139 A 4/1987 Brennan et al.
4,665,622 A 5/1987 Idan
4,697,226 A 9/1987 Verdin
4,707,595 A 11/1987 Meyers
4,738,044 A 4/1988 Osterhout
4,777,754 A 10/1988 Reynolds, Jr.
4,779,370 A 10/1988 Cormack ..... 42/101
4,799,325 A 1/1989 Booze ..... 42/100
4,853,529 A 8/1989 Meyers
4,856,218 A 8/1989 Reynolds, Jr.
4,876,815 A 10/1989 Terrill
4,876,816 A 10/1989 Triplett
4,894,941 A 1/1990 Karow, Jr.
4,905,396 A 3/1990 Bechtel
4,916,579 A 4/1990 Simms
4,916,713 A 4/1990 Gerber
4,926,576 A 5/1990 Maes et al.
4,934,085 A 6/1990 Lough
4,939,863 A 7/1990 Alexander et al.
4,991,183 A 2/1991 Meyers
4,993,833 A 2/1991 Lorey et al.
RE33,572 E 4/1991 Meyers
5,026,158 A 6/1991 Golubic
5,031,349 A 7/1991 Vogel
5,036,517 A 7/1991 Meyers
5,040,322 A 8/1991 Iturrey, Jr.
5,040,885 A 8/1991 Simms
5,042,048 A 8/1991 Meyer
5,052,801 A 10/1991 Downes, Jr. et al.
5,056,097 A 10/1991 Meyers
5,058,900 A 10/1991 Denen
5,064,988 A 11/1991 E'nama et al.
5,090,805 A 2/1992 Stawarz
5,107,612 A 4/1992 Bechtel ..... 42/103
5,111,587 A 5/1992 Plank
5,118,186 A 6/1992 Schratzenstaller et al.
5,205,044 A 4/1993 DePaoli
5,221,956 A 6/1993 Patterson et al.
5,249,501 A 10/1993 Waldman et al.
5,272,514 A 12/1993 Dor
5,299,375 A 4/1994 Thummel et al.
5,309,337 A 5/1994 Groben
5,355,608 A 10/1994 Teetzel
5,374,986 A 12/1994 Solinsky
5,400,540 A 3/1995 Solinsky et al.
5,425,299 A 6/1995 Teetzel
5,426,880 A * 6/1995 Ruger et al. ..... 42/69.03
5,430,967 A * 7/1995 Woodman, III et al. ..... 42/103
5,471,777 A 12/1995 McDonald
5,481,819 A 1/1996 Teetzel
5,526,749 A 6/1996 Teetzel
5,555,662 A 9/1996 Teetzel
5,581,898 A 12/1996 Thummel
5,584,137 A * 12/1996 Teetzel ..... 42/103
5,642,932 A 7/1997 Matthews
5,669,174 A 9/1997 Teetzel
5,685,105 A * 11/1997 Teetzel ..... 362/114
5,758,448 A * 6/1998 Thummel ..... 362/114
5,816,683 A 10/1998 Christiansen ..... 42/103
5,849,007 A 12/1998 Fuhrberg et al.
6,112,962 A 9/2000 Mathews ..... 224/192
6,185,854 B1 * 2/2001 Solinsky et al. ..... 42/103
6,190,025 B1 2/2001 Solinsky
6,276,088 B1 8/2001 Matthews et al. ..... 362/110

OTHER PUBLICATIONS

Smith & Wesson, SW99, Safety, Instruction & Parts Manual, Mar. 1999.
Heckler & Koch, Inc., HK USP Operators Manual, USP 9mm × 19mm, USP Caliber .40 S&W, USP Caliber, .45 ACP, May 2001 Edition.
Heckler & Koch, Inc., Operator's Manual, Mark 23, Pistol, Semi–automatic, Caliber .45 ACP, NSN 1005–01–426–8951, Oct. 1996.
Lock Perfection, Instructions for Use, All Glock Models, Aug. 1999.

* cited by examiner

AUXILIARY DEVICE FOR A WEAPON AND ATTACHMENT THEREOF

RELATED APPLICATIONS

This application is a continuation of application Ser. No. 09/109,048, filed Jul. 2, 1998, now U.S. Pat. No. 6,185,854, entitled "Auxiliary Device for a Weapon and Attachment Thereof" which is hereby incorporated by reference in its entirety.

FIELD OF THE INVENTION

The invention relates generally to an auxiliary (e.g., illumination) device for a weapon and, more particularly, to attaching an auxiliary device to a weapon.

BACKGROUND OF THE INVENTION

The need to be able to effectively see a target and aim a weapon in the direction of the target is well recognized. Auxiliary devices to facilitate illuminating a target or aiming a weapon, especially under low light conditions, are known. Examples of known auxiliary devices include scopes, illuminators, lasers, aiming lights and combined illuminator/laser units. For convenience, these (and other) devices are generally referred to herein as auxiliary devices. Attaching auxiliary devices to a weapon typically requires separate brackets or other mechanical components, which may necessitate tools, e.g., screwdrivers, coins, hex wrenches or bullets, for attaching the auxiliary device itself or the mechanical component. Alternatively, attaching and detaching the device or mechanical components to the weapon requires partial disassembly or modification of the weapon. Further, such systems typically require use of two hands to mount the device on the weapon, with both hands performing a function beyond merely gripping the weapon. This requirement presents several disadvantages. For instance, the user may be required to remove the trigger hand from the trigger area of the weapon. Moreover, attachment and detachment of these devices can be time consuming and, in law enforcement and military applications, such time may be critical to the safety of the weapon's operator or others.

As a result of these and other problems with conventional devices, the user typically leaves the auxiliary device mounted on the weapon or performs a time consuming operation to mount the device when needed. These alternatives are undesirable. For example, if the device is left mounted on the weapon, it cannot be used independently of the weapon despite the fact that in some situations, it is desirable to illuminate an area without pointing a weapon toward that area. Also, in the context of handweapons, for example, many holsters do not readily accommodate weapons having auxiliary devices mounted thereon. Thus, it is often difficult to holster or carry a weapon having such a device attached to it. This presents special problems for law enforcement officers and others. Additionally, the user may not want to use the device during daylight hours, but may want to attach the device to a weapon at night. Further, the user may want to be able to readily remove the device when it is no longer needed. Moreover, depending on the configuration of the auxiliary device, the user may need to replace its batteries. Preferably, the user should be able to perform this procedure quickly without the need for tools.

Another problem with conventional auxiliary devices is that the device is often wider than the weapon, or the device protrudes beyond the front end of the weapon. In the case of handweapons, a device mounted below the frame may protrude below the trigger guard. These characteristics often result in subjecting the auxiliary device to greater wear and tear because the auxiliary device often contacts various obstructions in the environment where the weapon is being used. For instance, a device extending beyond the end of a barrel of a weapon may collide with doorways, clothing, tree branches, or other objects, tending to tear the device apart from the weapon and possibly damaging, or rendering inoperable, the device or the weapon itself. Another problem is that an assailant may more easily disarm a user by grabbing an auxiliary device which extends substantially beyond the weapon. The danger of these and other problems occurring are greater at night or when ordinary vision is impaired.

Additionally, many prior auxiliary devices, especially illuminators, are bulky. This characteristic also is undesirable.

U.S. Pat. No. 5,430,967 addresses some of these issues for an auxiliary device for a weapon. The device described therein is provided with a clamping mechanism for attaching an auxiliary apparatus to a weapon having a frame. The clamping mechanism has projections which are biased by a flexible member toward corresponding recessed portions formed in the frame of the weapon. A retaining member is also provided. The retaining member may be moved to between an open and a closed position. While the '967 Patent overcomes some of the problems traditionally associated with the attachment of an auxiliary device to a weapon, it too leaves room for improvement.

For example, the existence of a flexible biasing mechanism results in the auxiliary device being somewhat flexibly attached to the weapon. This flexible attachment is not ideal in some circumstances, for example, for use with auxiliary devices requiring precise boresight alignment. Also, the attachment mechanism is relatively bulky, causing the auxiliary device to be relatively wider, resulting in an increase in the size of the device in at least one dimension. Moreover, the engagement of portions of the auxiliary device with the corresponding portions of the weapon is limited by the degree of flexibility of the flexible mechanism. Furthermore, the spring-loaded mechanism also limits the biasing force holding the auxiliary device to a weapon. As a result, this attachment approach may be successful on weapons, such as handweapons, which have relatively modest recoil forces, but may be somewhat less successful on other weapons, such as shotguns, where the greater recoil forces may cause the auxiliary device to dislodge from the weapon.

While lights and other devices primarily have been mounted to weapons, many weapons are not specifically designed to facilitate this. As a result, special brackets and other mounting devices often need to be used. Some weapons have mounting racks, but various drawbacks exist even with these types of devices. In many cases, it is difficult to mount a device to the weapon and/or complex mechanical structures are necessary.

Other problems and drawbacks with prior approaches exist.

SUMMARY OF THE INVENTION

One object of the invention is to overcome these and other drawbacks of known devices.

Another object of the invention is to provide a weapon and auxiliary device system that includes complementary mounting members on the weapon and on the auxiliary device to enable the auxiliary device to be easily and securely attached to the weapon, for example, by relative sliding movement.

Another object of the invention is to provide a weapon and auxiliary device system that includes complementary mounting members on the weapon and on the auxiliary device to enable the auxiliary device to be easily and securely attached to the weapon, for example, by relative sliding movement to a predetermined position, and which further includes a mechanism to fix the auxiliary device in the predetermined position.

Another object of the present invention is to provide an auxiliary device such as an illuminator or aiming light, or combination thereof, with a mechanism for attaching the device to a weapon and particularly a handweapon, such that the actual attachment or removal can be accomplished by a user with one hand, while the second hand is free to grip the weapon.

Another object of the invention is to provide a mechanism for attaching an auxiliary device to a weapon such that the device will maintain or better maintain boresight alignment even after the shocks of repeated weapon fire recoils.

Another object of the invention is to provide a mechanism for mounting an auxiliary device to a weapon without temporary or permanent disassembly or removal of any parts from the weapon to which the device is attached.

Another object of the invention is to reduce or minimize the size of an auxiliary device, for example, by providing an auxiliary device which may be attached to the frame of a weapon such that when the device is attached to the weapon, protrusion of the device beyond the overall dimensions of the weapon is reduced or minimized. Preferably, the width of the auxiliary device does not extend beyond the overall width of the weapon to any appreciable degree. Also, the auxiliary device has minimal or no protrusion beyond the front end of the weapon.

Another object of the invention is to provide a battery operated auxiliary device in which the batteries can be easily and readily replaced and such replacement can be performed without tools.

Another object of the invention is to provide a weapon comprising a frame to which an auxiliary device can be easily attached to and removed from the weapon by a user with one hand, while the second hand is free to grip the weapon (without tools) and when attached will hold boresight alignment to a high degree of precision.

These and other objects may be carried out according to various embodiments of the invention. According to one embodiment, the invention comprises a weapon and auxiliary device system that facilitates attachment of the auxiliary device to the weapon and removal therefrom. Preferably the auxiliary device may be attached to the weapon by relative sliding movement therebetween, to guide the auxiliary device to a predetermined position. According to one aspect of the invention, the system preferably further includes a mechanism for maintaining the auxiliary device in the predetermined position, for example, by providing a mechanism that automatically fixes the position once the predetermined position is reached. One advantage of this combination is that, once mounted, undesired movement of the auxiliary device relative to the weapon (e.g., due to recoil shock caused by firing the weapon) can be reduced or eliminated. Another advantage is that the auxiliary device can be easily mounted to or removed from the weapon with single-handed operation without tools. Various aspects of the invention relate to the system. Other aspects may be used alone on a weapon or an auxiliary device.

According to one embodiment, the auxiliary device comprises a housing with mounting members extending therefrom. The mounting members preferably, but not necessarily, are complimentarily-shaped with respect to mounting members of the weapon to which the auxiliary device is to be attached. Preferably, the mounting members are designed to provide a first positioning mechanism, where one is a male member and the other is a female member, spaced and oriented such that the auxiliary device may be mounted to the weapon by relative sliding movement between the weapon and auxiliary device to a predetermined position.

According to another aspect of the invention, the weapon and auxiliary device are provided with a second positioning mechanism. In one embodiment, the second positioning mechanism includes a male portion and a female portion. For example, a spring-loaded bar at the top of the auxiliary device may project for engagement into a transverse slot in the bottom of the weapon frame to prevent the auxiliary device from sliding forward or aft, e.g., when the weapon fires. Alternatively, the second positioning mechanism may include an opening on the weapon frame and a complementary projection on the auxiliary device that is engagable with the opening. Other alternatives exist. For example, the weapon alone may have a latch that engages a portion of the auxiliary device when in a predetermined position.

In any of the embodiments the male portion of the second positioning mechanism may include a biasing mechanism, e.g., a spring-biased mechanism, whereby the user manipulates a latch, button or other release mechanism which, under the influence of a spring or other biasing device, is typically maintained in a normally locked or a normally unlocked position. The spring-loaded projection may be contoured such that the auxiliary device can slide onto the weapon without having to manually depress the projection.

To remove the auxiliary device from the weapon, the spring biasing the second positioning mechanism is manually depressed (or otherwise moved) to allow disengagement of the second positioning mechanisms. Then, the auxiliary device may be slid forward for removal from the weapon.

In another embodiment, the grooves or tongues along the side of the weapon frame are not parallel to the frame and may or may not be parallel to each other. For example, the grooves can be located at an incline or angle with respect to the axis of the barrel of the weapon. In another embodiment, the grooves or tongues may be replaced by other suitable complementary engaging surfaces which allow relative sliding motion between the frame of the weapon and the auxiliary device.

In another embodiment, the grooves or tongues along the side of the weapon frame may be replaced with a rail along the bottom of the frame. A transverse slot or hole may be located in the bottom or side(s) of the rail.

In another embodiment, the male portion (e.g., bar or pin) is not spring-loaded. Rather it is mechanically moved to engage the female portion (e.g., slot or hole) in the bottom of the weapon frame and is mechanically lowered or allowed by gravity to fall to disengage the slot or hole when removal of the auxiliary device from the weapon is desired.

According to one embodiment of the invention, a weapon frame is provided with a pair of elongated side rails of a predetermined geometry formed along opposite sides of the frame extending from forward of a trigger guard to about the forward most end of the barrel. An auxiliary device comprising a housing is provided with structural members that extend from or form part of the housing, and have a predetermined geometry to enable the auxiliary device to mate with the rails of the weapon for attachment thereto.

These structures cooperate to locate and align the auxiliary device at a predetermined position with respect to the weapon.

According to another aspect of the invention, the predetermined position of the auxiliary device with respect to the weapon may be fixed by providing a second positioning mechanism on one or both of the weapon or auxiliary device to prevent or reduce mounted undesired movement of the auxiliary device relative to the weapon (e.g., due to recoil shock caused by firing the weapon). This mechanism may include a female portion and a male portion. For example the female portion may comprise a recess, transverse slot, circular opening or other female portion, formed in the bottom of the frame forward of the trigger guard. The male portion may comprise a pin, bar elongate projection or other male portion on the auxiliary device. The male portion may be biased to at least partially enter the female portion in the weapon frame once the predetermined position is reached. Preferably, the second positioning mechanism may lock the auxiliary device to the weapon frame without manipulation of that mechanism by the person attaching the auxiliary device to the weapon. Alternatively, the second positioning mechanism may tend to prevent the movement of the auxiliary device, without locking it to the weapon frame. In this case, the second positioning mechanism could include, for example, a detent ball mechanism or other structure.

According, to one embodiment, the auxiliary device is slid onto the frame of a weapon (in a first direction) via the first positioning mechanism and a second positioning mechanism is actuated to fix the position of the auxiliary device relative to the frame in at least the first direction. The second positioning mechanism preferably includes one component that moves in a direction perpendicular to the first direction.

Preferably at least a portion of the second positioning mechanism comprises a spring-loaded projection that projects from either the auxiliary device or the weapon into a portion of the other, without having to manually depress the projection. This facilitates the ease with which an auxiliary device can be reliably secured to a weapon. To remove the auxiliary device from the weapon, the spring biasing the second positioning mechanism is manually depressed (or otherwise moved) to allow disengagement of the second positioning mechanism. Then, the auxiliary device may be slid forward for removal from the weapon.

Other objects, features, and advantages of the embodiments will become readily apparent when the detailed description of the embodiment is read in conjunction with the drawing figures.

DETAILED DESCRIPTION OF THE EMBODIMENTS

Figure 1:
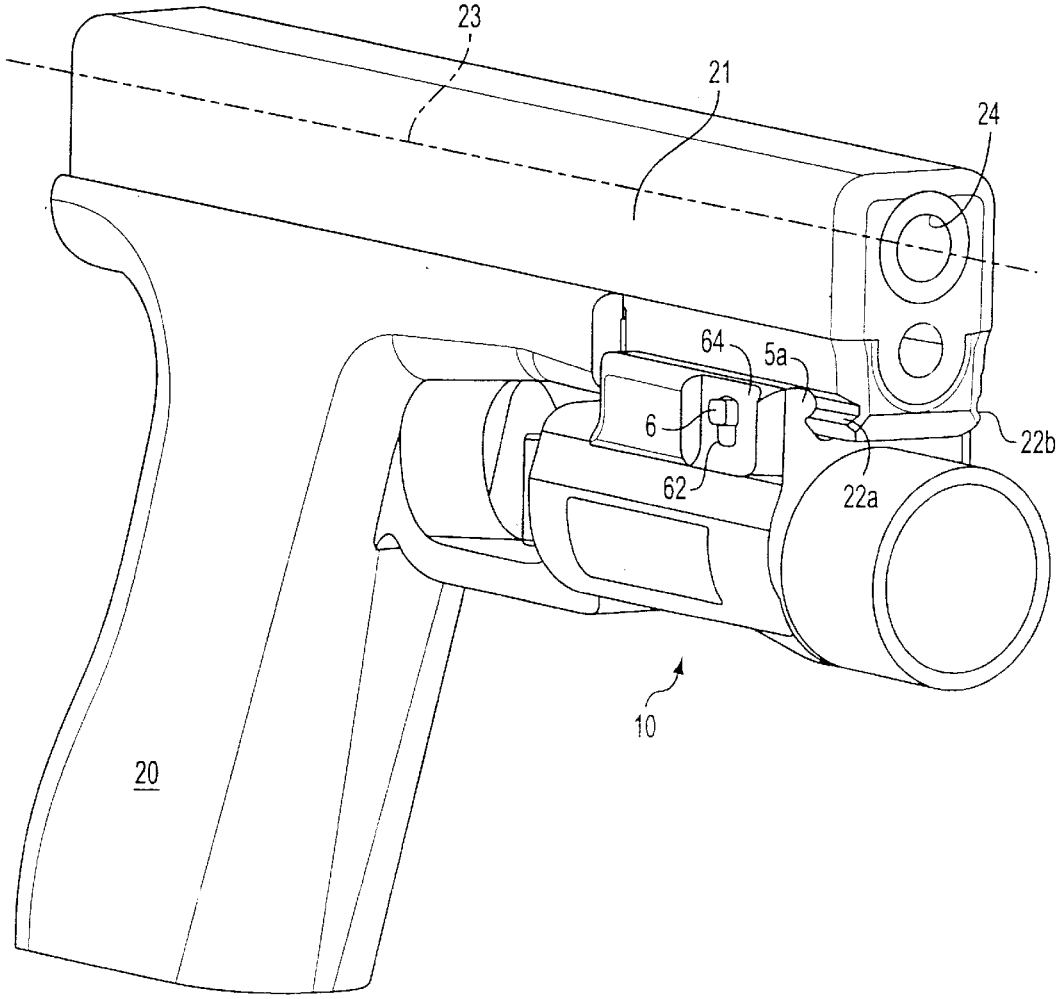
FIG. 1 is a perspective view of an auxiliary device mounted to a weapon.
Figure 2:
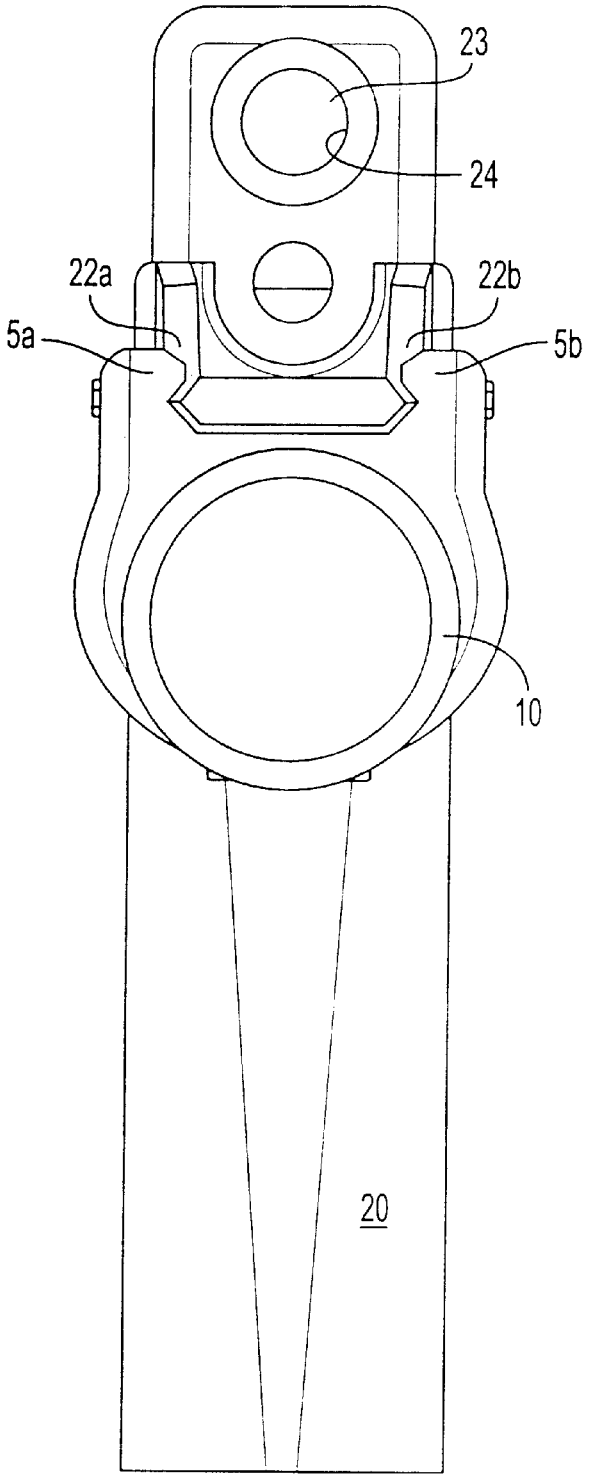
FIG. 2 is a front elevational view of the auxiliary device mounted to the weapon as in FIG. 1.
Figure 3A:
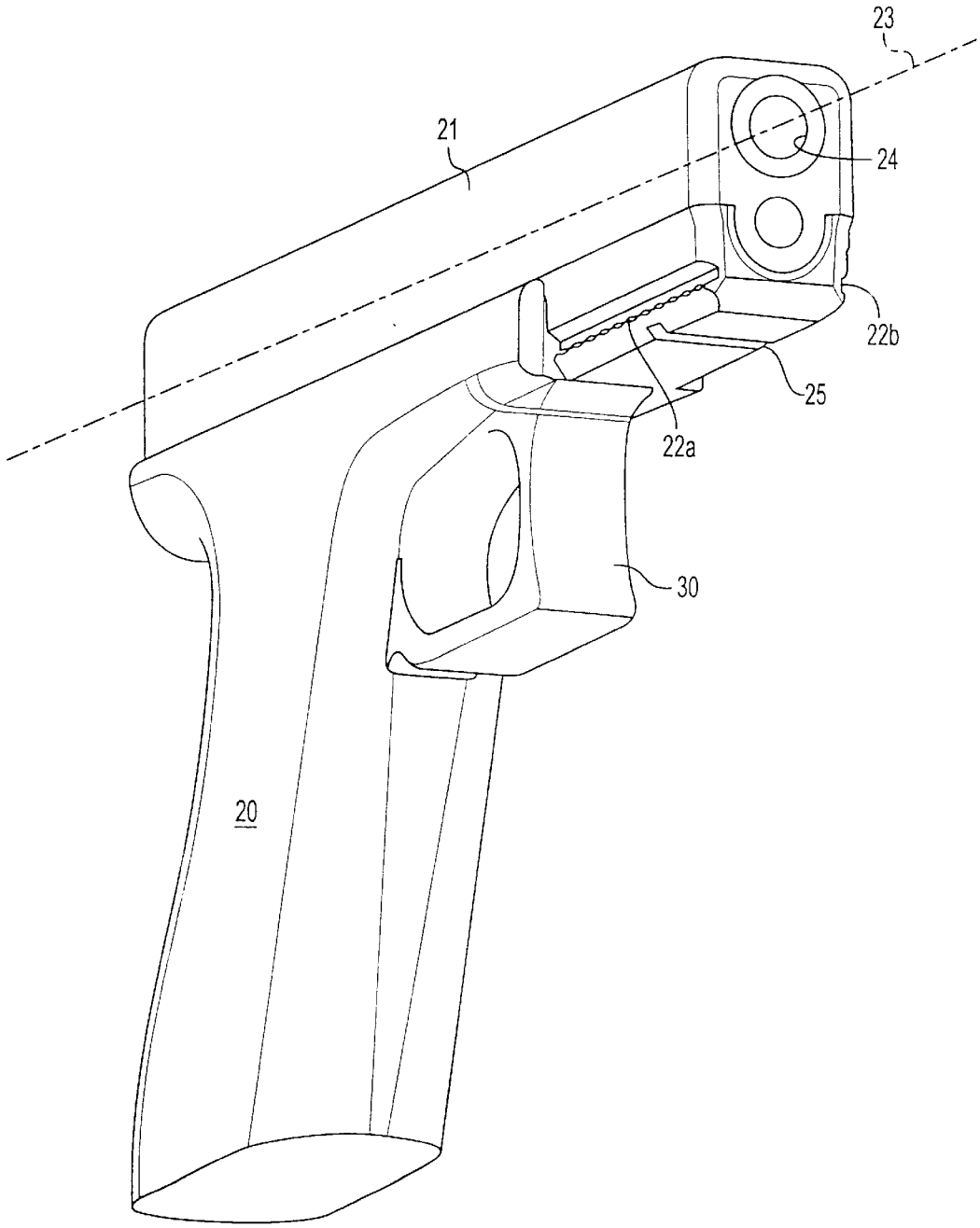
FIGS. 3A and 3B are is a perspective views of a weapons in accordance with two embodiments of the invention.
Figure 3B:
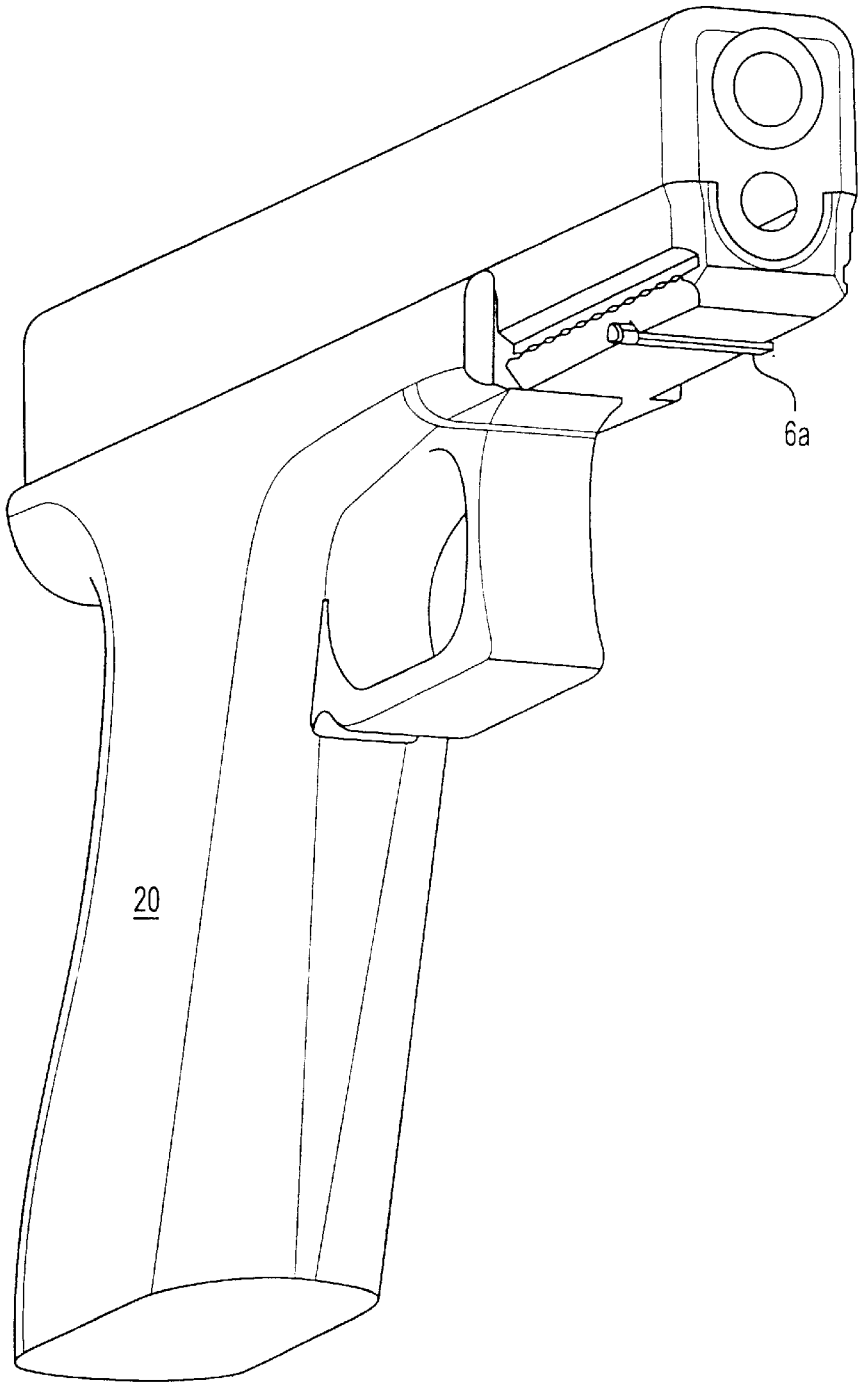
Figure 4:
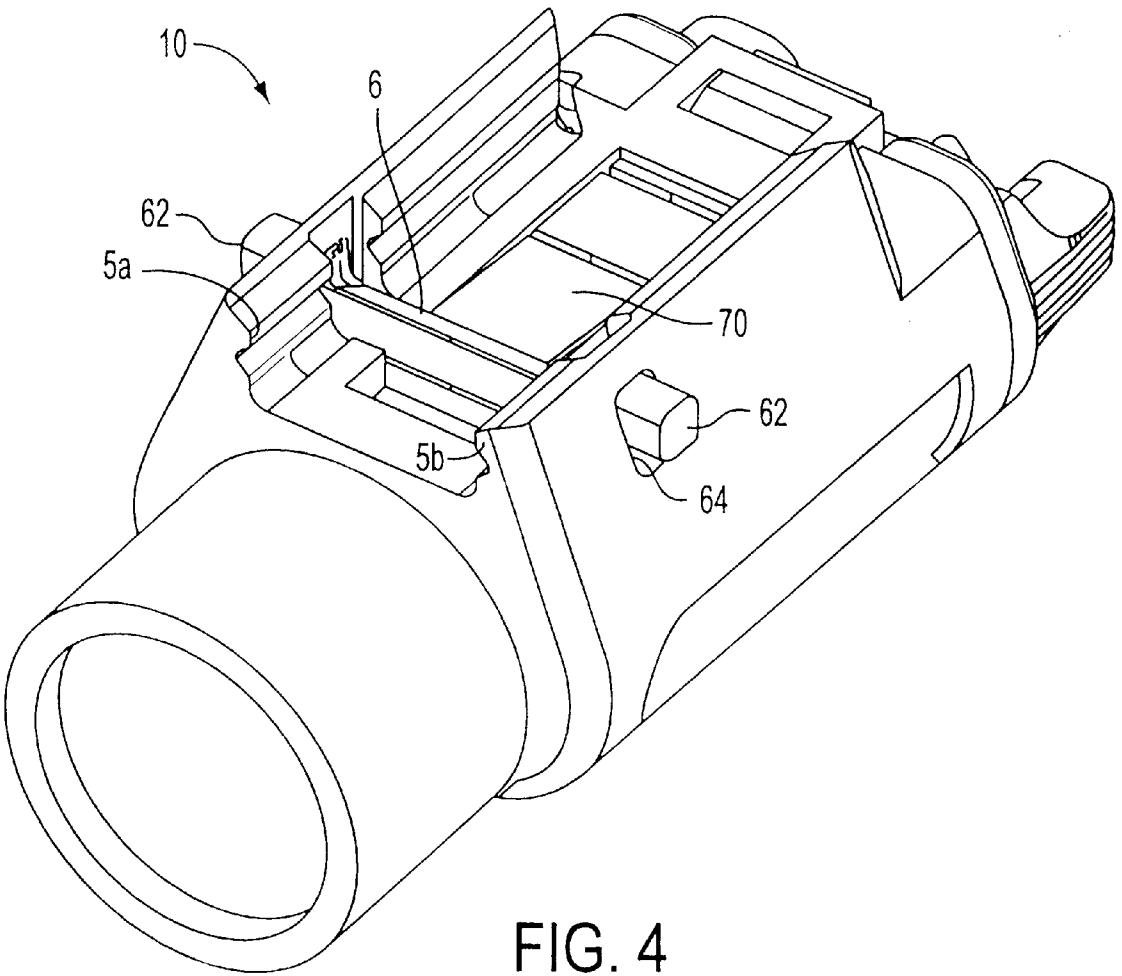
FIG. 4 is a perspective view of the auxiliary device of FIG. 1 in accordance with one embodiment of the present invention.

With reference to FIGS. 1, 2 and 4, there is depicted an auxiliary device 10 mounted to a pistol-type weapon 20. For convenience, the description that follows refers to the auxiliary device as an illuminator, which is a device generally used to cast light upon a target area or a portion thereof. This should not be construed as a limitation of the invention, however, as this embodiment is for illustrative purposes only. As those skilled in the art will appreciate from this disclosure, the novel features described herein may readily be applied to other auxiliary devices and weapons. Moreover, the figures are provided as examples only. It is to be understood that the invention is not limited to the particulars depicted in the figures.

According to one embodiment, weapon 20 comprises a weapon frame 21 with rails or grooves 22*a* and 22*b*, located in and extending along at least a portion of the weapon frame 21, preferably parallel with an axis 23 of the barrel 24. Preferably, the rails extend from about a trigger guard 30, to substantially the forward most end of frame 21. The weapon frame 21 also preferably includes a slot (or other recess), for example, an elongate transverse slot 25, aligned substantially perpendicular to the rails 22*a*, 22*b*. The slot 25 is preferably located between trigger guard 30 and the forward most portion of the frame 21.

Auxiliary device 10, as shown in FIGS. 1, 2 and 4, also preferably comprises a housing and structural members extending therefrom, e.g., rigid elongated projections 5*a* and 5*b*, extending along at least a portion of the auxiliary device 10. Preferably, the rigid elongated projections comprise tongues 5*a*, 5*b* designed to be compatible with grooves 22*a*, 22*b* of weapon 20. For example, the longitudinal tongues 5*a*, 5*b* may be spaced and sized such that they fit snugly within the grooves 22*a*, 22*b*, but are capable of being slid therealong. Together, the rails 22*a*, 22*b* and projections 5*a*, 5*b* cooperate to function as a first positioning mechanism.

The auxiliary device 10 preferably further comprises a projection, e.g., spring-loaded elongated bar 6 (FIGS. 1 and 4). The spring-loaded bar 6 is illustrated as being oriented substantially orthogonal to the longitudinal tongues 5*a*, 5*b*, but other orientations are possible. Preferably, spring-loaded bar 6 has a geometry that is complimentary to elongate transverse slot 25. For example, spring-loaded bar 6 may extend substantially across the width of auxiliary device 10. Spring-loaded bar 6 preferably has one or more ends 62 protruding through an opening 64 formed in a portion of auxiliary device 10 (e.g., an upright extension projecting from the housing). A spring 70 (FIG. 4) or other biasing mechanism preferably biases bar 6 upwardly. When the auxiliary device is being slid relative to the weapon, a portion of the weapon may overcome the bias force of the spring, until the auxiliary device is at a predetermined position with respect to the weapon, for example when the spring-loaded bar 6 is positioned in alignment with slot 25, whereupon, the spring causes the bar 6 to project into slot 25 to fix the auxiliary device in the predetermined position relative to the weapon. The engagement of bar 6 and slot 25 forms a second positioning mechanism and secures auxiliary device 10 onto frame 20 to prevent inadvertent removal or misalignment of auxiliary device 10 due to external influences such as recoil.

Figure 5:
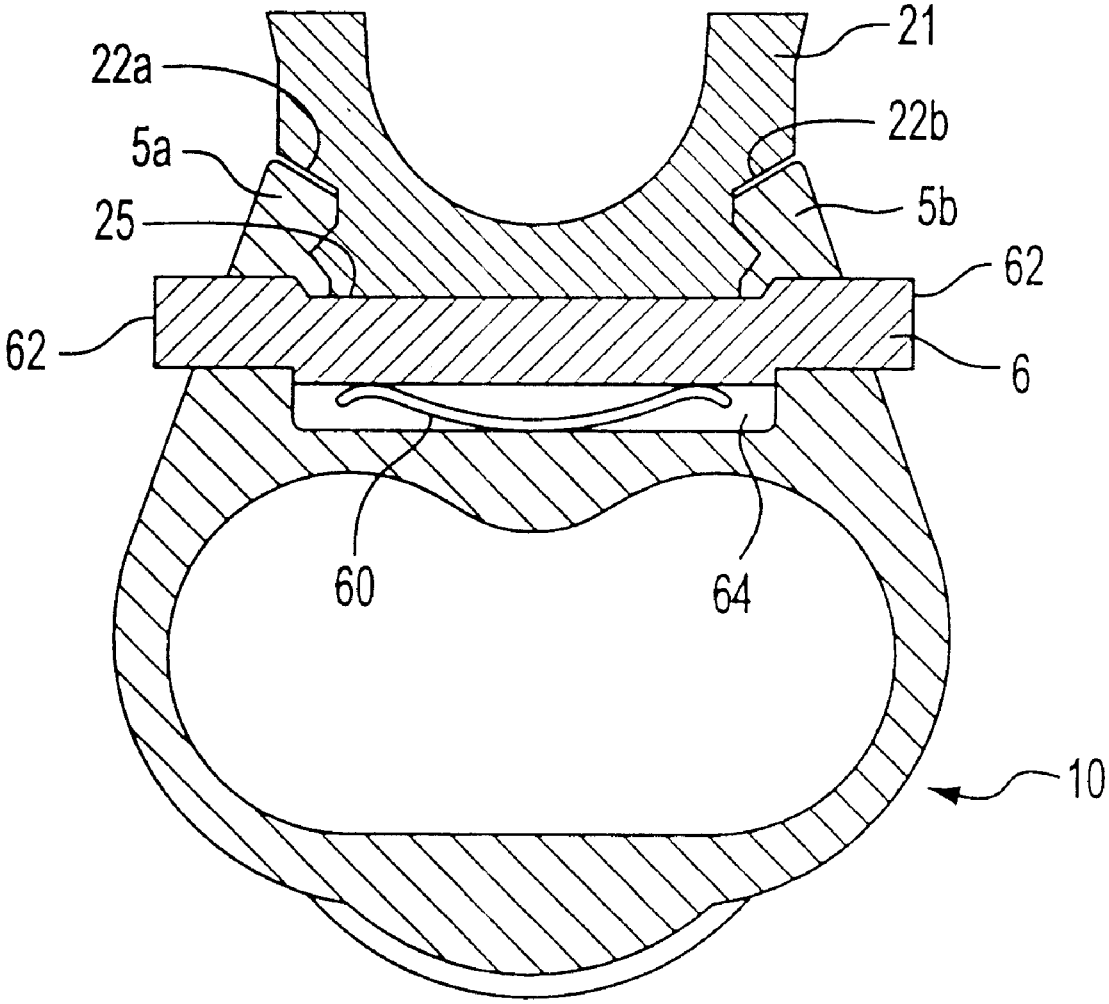
FIG. 5 is a cross-sectional view of the auxiliary device attached to the weapon frame and specifically depicting the latching mechanism as being upwardly biased by a leaf spring.

FIG. 5 depicts a cross-sectional view of an auxiliary device mounted to a weapon. In this embodiment, the first positioning mechanism includes, e.g., tongues 5*a*, 5*b* formed on the auxiliary device 10 in complementary engagement with corresponding grooves 22*a*, 22*b* formed on the weapon frame 21. Both the tongues and grooves are rigid structural elements to provide a rigid attachment between the auxiliary device 10 and the weapon frame 21. A second positioning mechanism is depicted in FIG. 5, including a transverse bar 6 which, under the biasing force of leaf-spring 60, is inserted into a transverse slot 25 formed on the weapon frame 21. The leaf-spring 60 is preferably securely positioned within an opening 64 formed in the top of the auxiliary device 10, and held in place in a suitable manner. The leaf-spring 60 normally biases bar 6 upwards and away from recess 64. When removing the auxiliary device 10 from the weapon frame 21, the user grasps opposing ends 62 of bar 6 and pulls downwardly to cause the partial compression of leaf-spring 60 and move bar 6 out of engagement with the groove 25.

In the embodiment of FIGS. 1–4, the auxiliary device 10 is mounted on the weapon by aligning the tongues (5*a* and 5*b*) with the weapon's grooves (22*a* and 22*b*) and sliding the auxiliary device 10 on the weapon 20 to a predetermined position. The transverse bar 6 and slot 25 are located such that when the auxiliary device 10 at the predetermined position, the bar 6 is aligned with transverse slot 25, such that the bar 6 projects into slot 25 by spring pressure or in other convenient ways (e.g., manually, under the influence of gravity or other mechanisms).

The mating of longitudinal tongues 5*a*, 5*b* and grooves 22*a*, 22*b* provides alignment of the auxiliary device 10 with the weapon barrel 24 and stability in the horizontal and vertical directions. Additionally, the tongues and grooves constrain the auxiliary device 10 in roll, pitch and yaw relative to the weapon. The second positioning mechanism (e.g., engagement of the transverse bar 6 and slot 25) prevents the auxiliary device 10 from sliding forward or aft during use and particularly during weapon fire due to weapon recoil.

According to another embodiment, male portions (e.g., longitudinal tongues 5*a*, 5*b*) may be located on the weapon frame and the female portion (e.g., longitudinal grooves 22*a*, 22*b*) may be located on the auxiliary device 10. The geometry of the portions making up the first and second positioning mechanism need not be exactly as disclosed. Various other geometries can be used to accomplish the above-identified objects of the invention.

For example, transverse slot 25 and the transverse bar 6 can be replaced by any other engaging devices position fixers, and/or position fixer receptacles, which tend to prevent relative movement of the auxiliary device 10 with respect to the weapon frame. For instance, a recessed counterbore may be formed in the weapon frame and a pin provided in the auxiliary device 10 such that the pin engages the counterbore when the auxiliary device 10 is installed on the weapon. A spring biased latch may project downwardly from the front portion of the weapon to lock over an edge portion of the auxiliary device, once in a predetermined position, to prevent relative movement. For example, such a latch may fix the position of the auxiliary device between the latch and the trigger guard. In this way, only the weapon needs to be provided with a second positioning mechanism. Other alternatives can be used.

Figure 6:
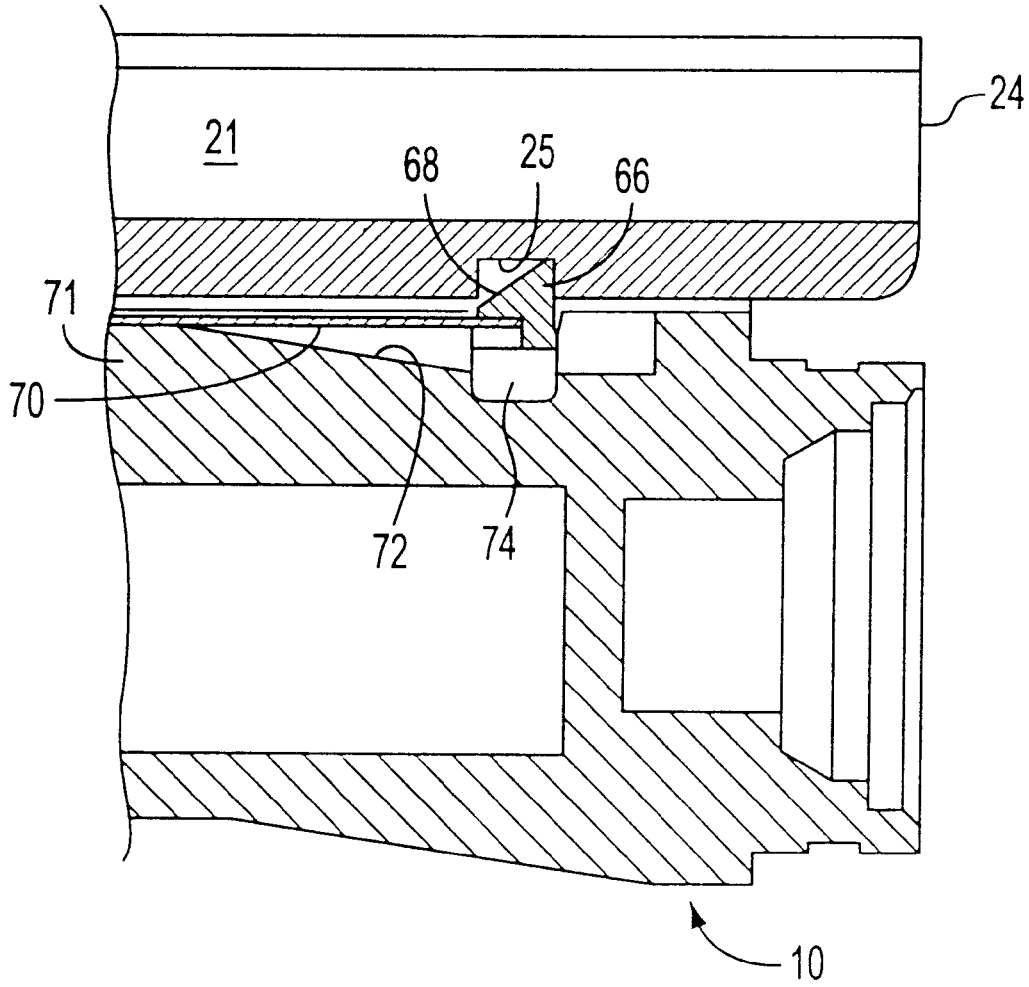
FIG. 6 is a cross-sectional view of the auxiliary device's transverse bar being upwardly biased by a biasing mechanism according to another embodiment.

FIG. 6 depicts a side cross-sectional view of another embodiment of the second positioning mechanism. In this embodiment, the weapon frame 21 has, as in the other depicted embodiment, a transverse slot 25 extending at least partially across the bottom of the weapon frame 21. In this alternative embodiment, the secondary complementary engaging mechanism formed on the auxiliary device 10 comprises a latching mechanism 66 which, under the influence of cantilevered spring 70, is upwardly biased into complementary engagement with transverse slot 25. Cantilevered spring 70 includes first and second ends, only one of which, 71, is attached to the auxiliary device 10.

The latching mechanism 66 preferably has at least one end of which is accessible by the weapon operator and may be manually manipulated to overcome the biasing force of cantilevered spring 70. When removing the auxiliary device 10 from the weapon, the user pulls the transverse bar 66 downwardly to overcome the influence of cantilevered spring 70. Cantilevered spring 70 then tends to come into contact with tapered surface 72, at which time transverse bar 66 is freed from slot 25 and the auxiliary device 10 may be slid forwardly and removed from the weapon.

Another aspect of the embodiments of FIGS. 4 and 6 is that the latching mechanism 66 may be formed with an inclined surface 68 at the rear end thereof. The inclined surface 68 facilitates the installation of the auxiliary device on the weapon. Specifically, when the first positioning mechanisms of the auxiliary device 10 and the weapon 20 are initially engaged, and the auxiliary device 10 is slid further onto the weapon, the inclined surface 68 is sized to contact the front end of the weapon. Under further sliding action of the auxiliary device 10, the front end of the weapon slides upwardly along inclined surface 68, causing latching mechanism 66 to overcome the biasing force of cantilevered spring 70 and to enter a recess 74 formed in the auxiliary device 10. Then, upon further sliding action, the latching mechanism 66 is eventually aligned with transverse slot 25, at which time the cantilevered spring 70 causes latching mechanism 66 to rise and lock within transverse slot 25. This (and other techniques for) automatic retraction as the auxiliary device 10 is slid onto the weapon simplifies installation, as it eliminates the need to manually retract the transverse bar 6 as the auxiliary device 10 is being installed. This automatic retraction of the transverse bar 6 can also be accomplished by contouring the leading edge of the weapon frame instead of or in addition to contouring the latching mechanism 66, and by other techniques.

As will be readily appreciated by those of ordinary skill in the art, the mechanisms for attaching the auxiliary device to the frame of the weapon may take different configurations. In a generic form, the auxiliary device is attached to the weapon frame using a first positioning mechanism and a second positioning mechanism. The first positioning mechanism preferably comprise complementary engaging surfaces on the auxiliary device and weapon frame. In a specific embodiment disclosed above, these complementary engaging features comprise longitudinal tongues 5*a*, 5*b* on the auxiliary device and complementary grooves 22*a*, 22*b* on the weapon frame 21. Other complementary engaging surfaces on the auxiliary device 10 and weapon frame 21 are readily contemplated by the embodiments of the invention. For example, the relative positioning of the tongues and grooves may be reversed such that the weapon frame 21 is formed with tongues, whereas the auxiliary device 10 is formed with complementary grooves. The first positioning mechanism may comprise other suitable complementary engaging mechanisms.

The second positioning mechanism preferably comprises a device which, under normal conditions, sufficiently retains the auxiliary device in a predetermined position relative to the weapon frame. The second positioning mechanism is preferably designed to secure the auxiliary device against movement when the weapon is subjected to recoil forces and other jarring influences which may be expected to be encountered in use and in the field. The second positioning mechanism in the embodiments has been described with respect to a biased transverse bar 6 which engages with an elongate slot 25 formed in the weapon frame. The second positioning mechanism of this particular embodiment acts to prevent the auxiliary device from movement during use. However, other second positioning mechanisms are within the scope of the invention, including spring biased bars or pins or other structures that engage a feature of the weapon from the side or sides or from below, detent mechanisms, latching mechanisms, locking mechanisms and other suitable mechanisms which releasably secure two relatively sliding parts.

For example, the second positioning mechanism may include the weapon barrel being formed with a recessed counter-bore into which a corresponding biased member, e.g, a ball bearing or a post, formed on the auxiliary device may be inserted. A drawn in FIG. 3B, the second positioning mechanism may optionally be formed from a spring-biased retractable bar 64, post, or ball bearing or other structure integrally formed on the weapon frame which engages a portion of auxiliary device 10, for example, but without limitation, a correspondingly shaped recess formed in the auxiliary device 10 or another portion of the auxiliary device 10. In each of the foregoing and other embodiments, depending on the application, the second positioning mechanism may be designed to lock or otherwise secure the auxiliary device with respect to the weapon frame or alternatively may, such as in the case of a detent mechanism, simply act to deter, but not completely prevent, relative movement between the auxiliary device and the weapon frame under abnormal conditions. For example, a detent could be of sufficient retention capability to resist relative movement due to weapon recoil forces but not be so strong as to prevent deliberate removal of the auxiliary device from the weapon, without first "un-locking" it.

Another aspect of the invention relates to the mounting members, e.g., grooves 22*a*, 22*b*, formed along the weapon frame. Preferably, the grooves extend from a point substantially at the trigger guard to the front of the weapon. These grooves 22*a*, 22*b* or other mounting members extend along the weapon frame to securely hold and retain the auxiliary device with respect to the weapon and facilitate locating the auxiliary device thereon. This further allows the secure fastening of the auxiliary device to the weapon frame without the use of spring hinges or other such devices which could result in the inadvertent dislocation of the auxiliary device from the weapon frame. The complementary mounting members comprising the first positioning mechanism thus form a rigid and secure mechanism for mounting the auxiliary device to the weapon frame.

In various embodiments depicted, grooves 22*a*, 22*b* are depicted as extending substantially parallel to the axis 23 of barrel 24. The invention, however, is not so limited. For instance, grooves 22*a*, 22*b* may be positioned at an incline with respect to the longitudinal axis 23 of barrel 24. Alternatively, grooves 22*a*, 22*b* may be replaced other suitable engaging surfaces which allow relative sliding motion between the weapon frame 21 and the auxiliary device 10.

Figure 7:
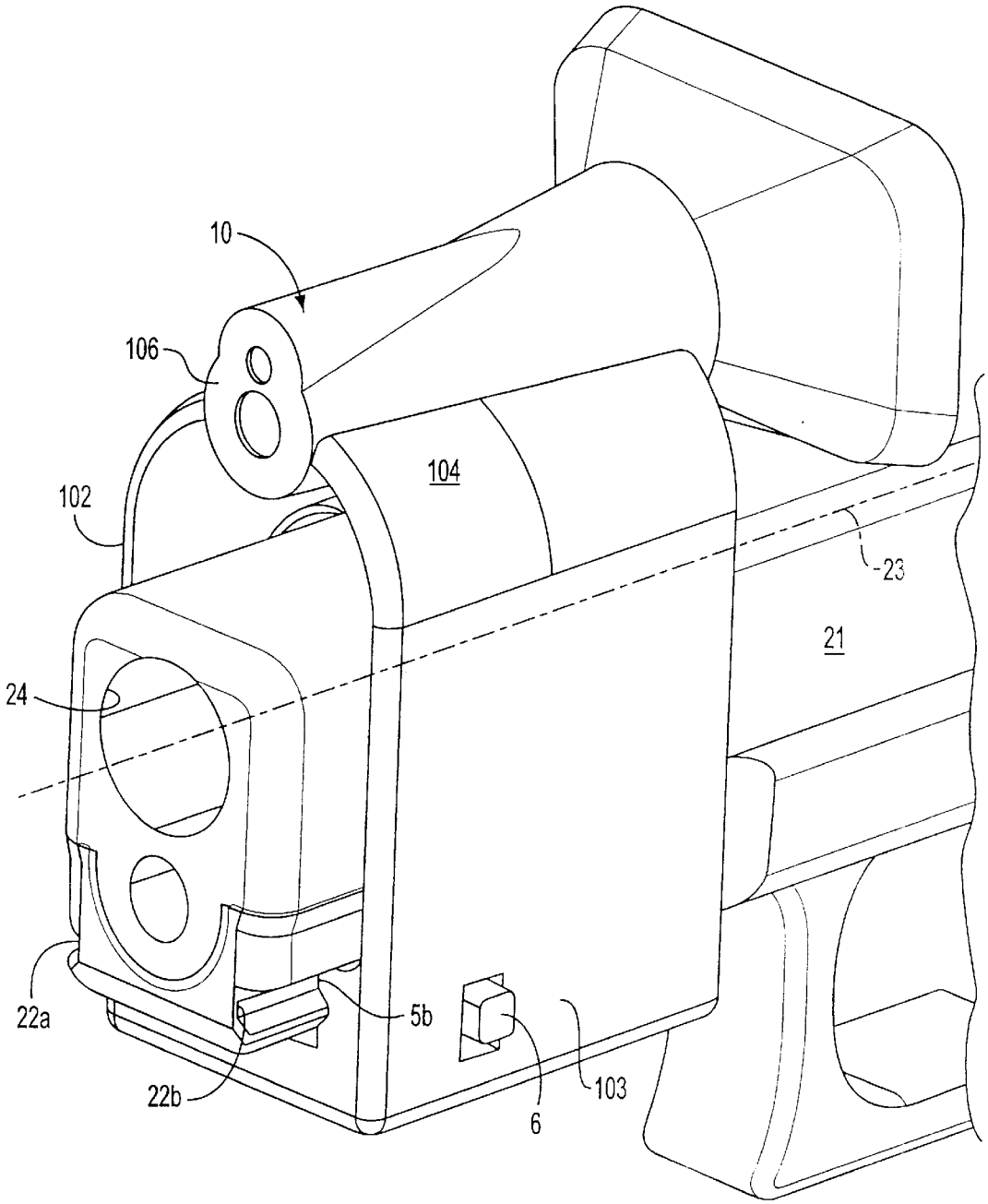
FIG. 7 shows a further attachment technique used to mount a scope or other auxiliary a device above the weapon.

FIG. 7 depicts another embodiment of the invention. In FIG. 7, an auxiliary device 10 is positioned above the weapon frame 21. The auxiliary device 10 preferably includes bar 6 (or other second positioning mechanism) which is adapted for complementary engagement with a corresponding portion of weapon 21, erg., transverse slot 25 formed at the bottom of the weapon frame 21. Weapon frame 21 preferably includes a first positioning mechanism, e.g., rails or grooves 22*a*, 22*b*, located in and extending along at least a portion of the weapon frame 21, preferably parallel with an axis 23 of the weapon frame 21. The auxiliary device 10 of the embodiment of FIG. 7 includes a hollow frame having first and second sides 102, 103 connected by an upper section 104 to a housing for the auxiliary device. An aiming light or other illuminating device 106 may be positioned in or on the housing and preferably is boresighted with the longitudinal axis 23 of the barrel 24.

Though the embodiment of FIG. 7 has been depicted in connection with a hollow arched housing through which the weapon frame 21 penetrates, other configurations for locating the auxiliary device 10 so that the aiming light or other illuminating device 106 is positioned above the weapon frame 21 are possible. For example, the weapon frame 21 could be formed with a pair of longitudinally extending tongues on opposite sides of barrel 24. Likewise, in such an alternative embodiment, a transverse slot or other second positioning mechanism 25 could be formed on top of the weapon frame 21 or on top of the barrel. In any event, no matter the configuration of the second positioning mechanism, preferably, the auxiliary device 10 preferably has a first positioning mechanism (according to various embodiments discussed herein or other positioning mechanisms) such that the auxiliary device 10 is engageable to mount on the weapon frame 21. The precise positioning and configuration of the positioning mechanisms can vary.

The leaf-spring 60 of the embodiment of FIG. 5 and the cantilevered spring 70 in the embodiment of FIG. 6 are but two of many possible biasing mechanisms that may be used in the embodiments of the invention. In addition to the springs for upwardly biasing the bar 6, other mechanical arrangements or combinations thereof, such as alternative forms of springs, wedges, screws or cams, which could cause the bar or other structural member to engage the slot 25 in the weapon, are within the scope of the invention.

This invention has been described in connection with various embodiments. These embodiments are for example only and are not intended to limit the invention. Various changes and modifications may be made to the embodiments without departing from the scope of the invention as defined by the appended claims. The invention encompasses all devices and equivalents which are within the scope of the claims which follow.

We claim:

1. An auxiliary device for use with a weapon, the auxiliary device comprising:

a housing:

at least one source of illumination located within the housing;

a first structural member extending upward from a first side of the housing and extending along at least a portion of a length of the first side of the housing;

a second structural member extending upward from a second side of the housing, wherein the second side of the housing is located opposite to the first side of the housing, and wherein the second structural member extends along at least a portion of a length of the second side of the housing such that it is substantially parallel to the first structural member, and wherein both the first and second structural members are substantially parallel to a central, longitudinal axis extending along a length of the housing; and a spring-biased mechanism extending across and along a top surface of the housing, and wherein the spring-biased mechanism is configured to be biased in a direction normal to the top surface of the housing.

2. The auxiliary device of claim 1, wherein the auxiliary device comprises an illuminator.

3. The auxiliary device of claim 1, wherein the auxiliary device comprises an aiming device.

4. The auxiliary device of claim 1, wherein the auxiliary device comprises an illuminator and an aiming device.

5. The auxiliary device of claim 1, wherein the first and second structural members comprise a first positioning mechanism.

6. The auxiliary device of claim 1, wherein the first and second structural members comprise mounting members that are complimentarily-shaped with respect to mounting members of a weapon to which the auxiliary device is adapted to be attached.

7. The auxiliary device of claim 1, wherein the first and second structural members comprise rigid, elongated projections.

8. The auxiliary device of claim 7, wherein the rigid, elongated projections comprise tongues sized and shaped to engage with grooves associated with a weapon to which the auxiliary device is adapted to be attached.

9. The auxiliary device of claim 7, wherein the rigid, elongated projections are sized to fit snugly within grooves associated with a weapon to which the auxiliary device is adapted to be attached, and wherein the rigid, elongated projections are capable of sliding along the grooves.

10. The auxiliary device of claim 1, wherein the spring-biased mechanism comprises a positioning member.

11. The auxiliary device of claim 10, wherein the positioning is in the form of a spring-loaded bar.

12. The auxiliary device of claim 11, wherein the spring-loaded bar includes an end portion, which upon manipulation by a user, overcomes the bias provided by the spring-biased mechanism.

13. The auxiliary device of claim 12, wherein the spring-loaded bar includes an end portion, which extends beyond at least one of the first structural member and the second structural member.

14. The auxiliary device of claim 13 further comprising at least one additional source of illumination.

15. The auxiliary device of claim 14 wherein the at least one additional source of illumination is different from the at least one source of illumination.

16. The auxiliary device of claim 14 wherein the at least one additional source of illumination comprises an illuminator, a laser or an aiming light.

17. The auxiliary device of claim 11, wherein the spring-loaded bar includes an end portion, which extends beyond at least one of the first structural member and the second structural member.

18. The auxiliary device of claim 11 Further comprising at least one additional source of illumination.

19. The auxiliary device of claim 18 wherein the at least one additional source of illumination is different from the at least one source of illumination.

20. The auxiliary device of claim 18 wherein the at least one additional source of illumination comprises an illuminator, a laser or an aiming light.

21. The auxiliary device of claim 10, wherein the positioning mechanism comprises a spring-loaded bar biased to move in a direction normal to the top surface of the housing for engagement into a slot associated with a weapon.

22. The auxiliary device of claim 21, wherein the spring-loaded bar includes first and second end portions, and wherein a user may use at least one of the end portions to cause compression of the spring to move the bar out of engagement with the slot associated with the weapon.

23. The auxiliary device of claim 1, wherein the first and second structural members comprise rigid, elongated projections that are sized to fit snugly within grooves associated with a weapon to which the auxiliary device is adapted to be attached such that the rigid, elongated projections are capable of sliding along the grooves, and wherein the spring-biased mechanism is biased to move in a direction normal to the top surface of the housing for engagement into a slot associated with a weapon.

24. The auxiliary device of claim 1, wherein the spring-biased mechanism comprises a latching mechanism.

25. The auxiliary device of claim 24, wherein the latching mechanism comprises a cantilevered spring, the cantilevered spring being operable to bias the latching mechanism into engagement with a complementary position associated with the weapon.

26. The auxiliary device of claim 24, wherein the latching mechanism is configured to be manually manipulated to overcome the biasing force of the cantilevered spring.

27. The auxiliary device of claim 24, when the spring-biased mechanism further comprises an inclined surface, wherein relative sliding movement between the auxiliary device and weapon causes the inclined surface to cause the latching mechanism to overcome the biasing force of the spring-biased mechanism until the latching mechanism is aligned with a slot associated with the weapon.

28. The auxiliary device of claim 1, wherein the spring-biased mechanism includes a portion, which upon manipulation by a user, overcomes the bias provided by the spring-biased mechanism.

29. The auxiliary device of claim 1 further comprising at least one additional source of illumination.

30. The auxiliary device of claim 29 wherein the at least one additional source of illumination is different from hat least one source of illumination.

31. The auxiliary device of claim 29 wherein the at least one additional source of illumination comprises an illuminator, a laser or an aiming light.

32. An auxiliary device for use with a weapon, the auxiliary device comprising:

a housing:

a plurality of sources of illumination located within the housing;

a first structural member extending upward from a first side of the housing and extending along at least a portion of a length of the first side of the housing;

a second structural member extending upward from a second side of the housing, wherein the second side of the housing is located opposite to the first side of the housing, and wherein the second structural member extends along at least a portion of a length of the second side of the housing such that it is substantially parallel to the first structural member, and wherein both the first and second structural members are substantially parallel to a central, longitudinal axis extending along a length of the housing; and a spring-biased mechanism extending across and along a top surface of the housing, and wherein the spring-biased mechanism is configured to be biased in a direction normal to the top surface of the housing.

33. The auxiliary device of claim 32 wherein a first source of illumination within the plurality is different from a second source of illumination within the plurality.

34. The auxiliary device of claim 32 wherein the plurality of sources comprises an illuminator, a laser or an aiming light.

35. The auxiliary device of claim 32 wherein the plurality of sources comprises an illuminator and an aiming light.

* * * * *

UNITED STATES PATENT AND TRADEMARK OFFICE

CERTIFICATE OF CORRECTION

PATENT NO. : 6,574,901 B1
DATED : June 10, 2003
INVENTOR(S) : Kenneth S. Solinsky et al.

It is certified that error appears in the above-identified patent and that said Letters Patent is hereby corrected as shown below:

Column 11,
Line 30, insert -- member -- after "positioning";

Column 12,
Line 17, replace "the" to -- a --;
Line 18, replace "when" to -- wherein --.

Signed and Sealed this

Ninth Day of September, 2003

JAMES E. ROGAN
*Director of the United States Patent and Trademark Office*